United States Patent [19]

Damm

[11] Patent Number: 4,617,978

[45] Date of Patent: Oct. 21, 1986

[54] METHODS FOR THE COMPACTION OF FOUNDRY MOLDING MATERIAL

[75] Inventor: Norbert Damm, Karlsdorf-Neuthard, Fed. Rep. of Germany

[73] Assignee: BMD Badische Maschinenfabrik Durlach GmbH, Karlsruhe, Fed. Rep. of Germany

[21] Appl. No.: 704,774

[22] Filed: Feb. 25, 1985

[30] Foreign Application Priority Data

Feb. 23, 1984 [DE] Fed. Rep. of Germany ..... 3406466

[51] Int. Cl.[4] ..... B22D 15/00

[52] U.S. Cl. ..... 164/37

[58] Field of Search ..... 164/38, 37, 212, 39, 164/40, 48, 169, 195

[56] References Cited

U.S. PATENT DOCUMENTS 3,233,291 2/1966 Miller ..... 164/37

4,230,172 10/1980 Uzaki ..... 164/212

FOREIGN PATENT DOCUMENTS 298425 10/1971 U.S.S.R. ..... 164/37

*Primary Examiner*—Nicholas P. Godici

*Assistant Examiner*—G. M. Reid

*Attorney, Agent, or Firm*—Antonelli, Terry & Wands

[57] ABSTRACT

In a process for the compaction of foundry mold making material, more specially foundry sand, using a pressing plate placed directly on the material and accelerated to a speed of up to 20 meters per second, an efficient and even compaction of the material over the full height thereof is made possible by accelerating the pressing plate in an initial phase lasting for up to 50% of the total duration of the compaction stroke progressively up to the maximum speed, then moving it in an ensuing main phase at a more or less constant speed and finally slowing it down degressively in a terminal phase, lasting for up to 30% at the most of the overall stroke time, the driving force being preferably supplied by a captive gas volume under high pressure and opposed by a hydraulic counter force, the effect of said counter force as an opposing load decreasing during the compaction stroke by rapid discharge of a hydraulic liquid.

11 Claims, 7 Drawing Figures

FIG. 1

METHODS FOR THE COMPACTION OF FOUNDRY MOLDING MATERIAL

BACKGROUND OF THE INVENTION

The present invention relates to methods and apparatus for the compaction of foundry molding material, more specially foundry sand, using a pressing plate acting directly on the surface of the molding material, and travelling during its working stroke with a speed of up to 20 meters per second.

During the course of the last few years the technology of compacting foundry molding materials has entered into a stage of significant development, the guiding star of such improvements having been more particularly the concept of making working conditions in the industry less arduous for the labor employed, and paying special attention to the quality of the air and to the noise level. To take an example, because of the amount of noise produced there has been a swing away from customary shaking and combined pressing and shaking in favor of pneumatically operating machines, as for example mold blasting machines, in which precompaction is able to take place by the deceleration of a pneumatically accelerated volume of molding material on the pattern and the pattern plate. In this case mechanical postcompaction is generally necessary in order to attain a sufficiently high degree of strength at the outline or contour of the mold.

Of late compacting methods operating purely pneumatically have been devised, in which after the molding material has been deposited in the flask, it is subjected to an impact-like pulse of gas under pressure, that is to say, with gas, which has been highly compressed by a compressor or the like or gas in the form of mixture such that it may be exploded. While it is true that such a method has made it feasible to produce a dramatic decrease in the costs of mold making as compared with conventional methods and the quality of the mold has been greatly improved, in the case of a large number of pattern forms unforeseen difficulties have been experienced in mold production from some patterns. On the other hand the new method does not make it possible to mold the center riser or the pouring basin directly, because the back of the mold remains relatively soft. In the case of such forms of materials as for example spheroidal graphite cast iron or cast steel, a hard mold back and, because of loads during casting, a high degree of hardness throughout is desired, this again making it necessary for the mold to be mechanically pressed in a further working step so that the said new method becomes excessively involved technically. Generally one may say that while such compaction methods do make it possble to reduce mold making costs, the practical applications have so far been limited.

Furthermore proposals have been made recently to drive pressing members such as pressing platens, diaphragms, pressing punches or the like by gas under pressure, but however such methods have not advanced to the stage of being practically important, most probably because the compacting effect has not been any better than that of conventional hydraulic or pneumatic pressing methods.

Lastly there has been a proposal (see "Litejnoe Proizvodstvo in Deutsch" 1963, no. 3, pages 6 to 9) to accelerate a plate freely resting on the molding material by a pulse. Such so-called "high velocity pressing" is made possible by igniting an explosive material to violently drive an impact piston in a cylinder so that the piston is rammed against a pressing plate and gives up its kinetic energy to the plate. Consequently the pressing plate is very abruptly accelerated up to its maximum speed and during the compaction stroke it is braked by the internal friction of the mold material particles and decelerated to zero velocity. The changes in the rate of deceleration as a function of time are largely dependent on the elastic properties of the pressing plate and the damping behavior of the mass of molding material. Fluctuations in the properties of the molding material as are likely in practice, and different heights of the mold material, necessary for different patterns, lead to different compacting effects, that are furthermore interfered with by superimposed impact waves. In order to avoid axial impact waves from coming into being, the propelling gas over the impact piston is allowed to expand to zero pressure through exhaust ports even before the impact on the pressing plate.

In writings on the subject it has furthermore been pointed out that spalling cracking of the back of the mold or even damage to the material of the mold are likely, apparently because the compression of the back of the mold is excessive owing to the high initial acceleration so that a mold is in danger of cracking when it is depressurized. This method would seem so far only to have been used on a laboratory scale, because of these shortcomings as noted and also because in the case of a normal overall size of the flask and a correspondingly large compaction stroke high explosives with a correspondingly high energy content had to be employed, which naturally constitute a safety risk. An advantage to be encountered with such dynamic presses is however the high degree of hardness of the mold attainable.

GENERAL OUTLINE OF THE INVENTION

One aim of the present invention is to so improve and further develop the last-named method that even compaction becomes possible.

A further object of the invention is to make possible a reproducible degree of compaction in such method.

Taking as a starting point the method noted initially herein and for achieving these and other aims, the method of the invention is so designed that the pressing plate progressively accelerates in a starting phase for up to 50% of the overall stroke time till it reaches the maximum velocity, is then propelled with a substantially constant speed and in a terminal part the stroke degressively decelerates for up to 30% at the most of the overall stroke time.

The method of the invention firstly leads to a gentle initial acceleration of the pressing plate and therefore of the molding material as well so that excessive pre-compaction of the back of the mold is avoided. After this initial phase the compaction is continued in the main phase, in which the maximum plate speed is reached and is maintained at a more or less constant level, and leads to an ever increasing compaction of the mold material over the full height thereof. This represents an improvement over pure impulse compaction inasfar as, because of the plate speed/time function, the compaction pressure is maintained longer and is only decreased in the terminal phase, such decrease in plate speed being degressive. This control in the pressure leads to an even mold hardness for the full height of the mold. The absolute value for the mold hardness may be pre-set by varying the setting for the maximum plate speed.

In accordance with a further teaching, a form of the present invention, which lends itself to use with the above-noted form of method, and furthermore with pure gas presure and impulse compaction methods, is one in which the speed of the pressing plate is made inversely proportional to the height of the mold making material.

It has in fact been observed in this respect that, surprisingly, when using a low mold, a higher plate speed is needed in order to produce the same equally satisfactory degree of compaction than with a higher mold.

For the production of molds with heights of up to 200 mm the said plate speed may best to be between 20 and 12 meters per second, for mold heights between 200 and 400 mm the plate speed may be between 12 and 7 meters per second, while if the height is greater than 400 mm the speed should be in a range of 7 and 2 meters per second. This makes it possible to run the process with reproducible degrees of compaction as a function of the height of the mold making material or the height of the mold respectively.

According to a preferred working example of the invention, the pressing plate is driven using loaded spring-like drive means and more specially means in the form of a sealed off volume of gas under high pressure or "gas spring" adapted to store energy and release it instantaneously for driving said plate. The driving force yielded by the volume of gas under pressure is therefore transmitted directly and suddenly to the pressing plate and not, as in related prior constructions, caused to act indirectly by accelerating an impact piston that is then braked or decelerated at the pressing plate. The direct drive according to the invention makes it possible to obtain the desired speed characteristic of the moving part with reproducible compacting effects.

It is an advantage if the pressurized gas is not discharged but is recompressed after expansion and is never lost from the driving system. As compared with the conventional pressurized gas compaction method there is then the sizable economic advantage that it is no longer necessary for a new volume of gas to be supplied for each compaction stroke and as compared with the explosion method there is no discharge of exhaust gas into the atmosphere and it is not necessary to provide special ventilation facilities for this reason.

As part of a still further feature of the invention, the maximum speed of the pressing plate is adjusted by the level of the gas pressure and the drop in pressure with time and therefore the change in speed as a function of time are controlled by a hydraulic counter pressure.

The level of the gas pressure controls the maximum plate speed and is set taking into account the height of the mold material and/or the desired amount of compaction. In this respect one may say as a rule that the gas pressure is to be higher, the higher the desired pre-compaction and the lower the height of the mold material. The effect of the drop in pressure of the gas as a function of time, which is controlling for the changes in acceleration or deceleration, may be controlled with very simple mechanical means by the hydraulic counter pressure.

In accordance with a further method of controlling the plate speed one form of the invention is possible in which the volume of pressurized gas is in communication with one or more sealed off volumes of gas under a high pressure, that are connected during the course of the decrease in pressure. This makes it possible, for example, for the maximum plate speed to be maintained over a long period of time or during a longer stroke, even although the volume of gas under pressure is small, viz. without a large pressure storage means being needed. Putting a number of volumes in circuit in series furthermore makes possible a simple way of control by the connection and turning off of individual volumes of gas.

As part of a still further working example of the invention, the pressing plate is disconnected from the driving force of the volume of gas in the terminal phase of the motion and is its then slowed down simply by the resistance of the mold material opposing the inertia of the pressing plate until the pressing plate reaches its terminal position.

In place of a pneumatic drive the method of the invention may furthermore be run with an apparatus in which the pressing plate is driven electromagnetically, since in the case of such a drive high rates of acceleration and high plate speeds are possible. For controlling the plate speed magnetic fields of controlled intensity may be produced along the path of travel of the pressing plate and caused to take effect.

Apparatus for performing the method of the invention may be based on a conventional system comprising a pattern plate, a flask to receive the molding material and having a filling frame, and furthermore a pressing plate, placed above the frame and equipped with a drive to cause the pressing plate to move into the filling frame compressing the mold making material. Such known forms of apparatus have for example been used for static pressing with a hydraulic drive.

In keeping with the present invention such a basic form of apparatus is improved inasfar as it is characterized by a drive in the form of a storage means for gas under high pressure and whose one confining wall is in the form of a drive piston that is connected with the pressing plate, the piston being acted on by a hydraulic counter-loading means for opposing motion thereof. The hydraulic opposing load may be in the form of enclosed hydraulic fluid whose discharge speed may be controlled to obtain the desired drop of gas pressure and the desired speed of the pressing plate respectively. In this respect the discharge speed of the hydraulic fluid is to be somewhere in a range in excess of 10 meters per second in order to attain the maximum plate speed of up to 20 meters per second. In one possible form of the invention the discharge speed of the hydraulic medium is able to be varied for control purposes of the pressing plate.

As part of a further possible form of the invention, the volume of the pressurized gas storage means may be preset so that the overall stroke and the pressure level may be made to match the height of the mold making material. The variation in pressure along the overall stroke may furthermore be affected or controlled by having the pressurized gas storage means connected with at least one external gas storage means that may be put in circuit.

Furthermore the discharge ports of the hydraulic space, whose cross section may be so designed that the hydraulic medium may discharge at a rate of over 10 meters per second, may be isolated by switching elements from the rest of the hydraulic circuit and joined by a way of a duct with a relatively large cross section with a discharge tank. The pressure of the hydraulic source may be between 100 and 300 bar.

Furthermore the pressurized gas storage means may be joined with at least one such external storage means with a valve for connection thereof, and it may be formed by a pressure cylinder with the driving piston running therein, there being a setting piston to change the volume of pressure cylinder. Such a driving piston may be a double acting one so as to form on the one side the moving termination of the pressurized gas storage means and on the other side the moving termination of the hydraulic chamber. Furthermore the driving piston may have a hollow piston rod, opening towards the pressurized gas storage means, for acting on the pressing plate and the setting piston may have a cylindrical head projecting into the piston rod.

In the gas storage means the pressure may be held at a value between 50 and 200 bar in the initial position of the pressing plate. Furthermore the ratio between the pressurized gas storge volume and the displacement volume of the driving piston may be at least five to one.

In accordance with another feature of the invention, the inlet and outlet ports of the hydraulic chamber may open into at least two inlet and outlet ducts and the hydraulic supply means may be connected by way of a control valve, a check valve and a ring duct with these two ducts, said ring duct being joined with the discharge tank by way of a check valve with control means for opening it. The said control valve may be so arranged that it connects the hydraulic chamber with the hydraulic supply in a first position and lets off pressure from the control duct of the said controlled check valve so that same closes and in a second position connects the control duct with hydraulic supply means so that the check valve opens against the pressure in the ring duct and connects the hydraulic chamber with the discharge tank.

In accordance with a further development of the invention, the pressing plate is able to move axially in relation to the driving piston to a limited extent. This enables the pressing plate after the expansion of the volume of gas to move on because of the kinetic energy of the plate in order to effect residual compression in the terminal phase.

In conjunction with a further useful form of the invention, the pressing plate is designed to match the outline or contour of the pattern. In particular, it may have individual portions corresponding in position to the sunken parts of the pattern in order to make possible an even compacting effect through the height of the molding making material whatever the height of the pattern at a particular point.

It is advantageous if the mass of the pressing plate is made inversely proportional to the height of the mold material or mass thereof. The degree of compaction of the mold material caused by the impact deceleration of the molding material over the contour of the pattern depends on, among other factors, the mass to be decelerated made up of the molding material and the press plate. Because of the inverse proportionality of the mass with a low height of the mold making material, the proportionally higher plate mass acts vicariously in place of the small mass of material, and together with the higher speed aimed at in the case of a low material height leads to a comparatively higher compaction pulse with a correspondingly high intensity of compaction.

A further advantage is reached if the mass of the pressing plate and of the molding material have a ratio of between one to one and one to ten. Again, the selection of the mass of the pressing plate is a further factor that affords a simple way of influencing the plate speed and the change in speed. For the same driving force it is possible to use a pressing plate with a lower mass to get a shorter initial phase and a higher speed.

If the driving force for the method of the invention is produced electromagnetically, the apparatus for use in the method may be characterized by having the drive means made up of a stack of coaxial electromagnetical coils with a armature running into them and fixed to the pressing plate. This makes it possible for the pressing plate to be accelerated in accordance with the desired speed function.

If desired there may be means for controlling the current flowing through each winding in order to have an influence on the plate speed and the speed-time function.

This is something that may furthermore be produced by switching the windings on and off individually.

It is advantageous if the armature is arranged to move freely within the windings and for it to be latched in the lifted starting position by a hold or retaining winding with a centering function.

In what follows an account will be given of working examples of the invention using the drawings.

LIST OF VARIOUS VIEWS OF THE FIGURES

DETAILED ACCOUNT OF WORKING EXAMPLES OF THE INVENTION

Figure 1:
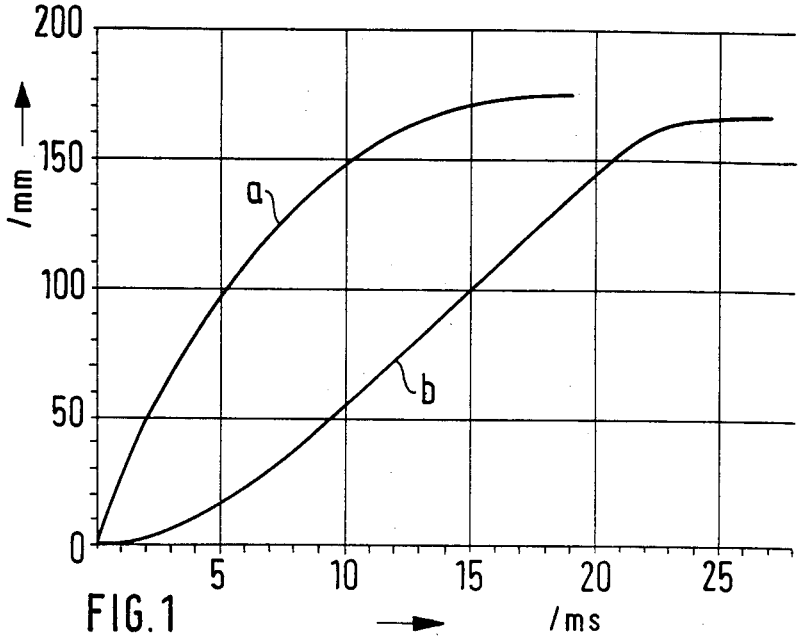
FIG. 1 is a time-displacement graph applying for a prior art compaction method and for one in accordance with the invention.

Turning first to the displacement-time function or curve a of FIG. 1, it can be seen motion during acceleration by an impulse in accordance with the prior art, that is to say socalled "high-speed-pressing". It will be gathered from the form of the curve a that per unit time the velocity of displacement firstly rapidly increases but then steadily decreases during the entire displacement. The curve b of this FIG. 1 indicates the displacement in the method in keeping with the invention, in which the press starts moving at a slow plate speed and in the main phase moves with a more or less steady speed before being degressively slowed down or braked in the terminal phase. In this respect the initial phase lasts for about 10 to 50% of the overall time of motion, whereas the terminal phase lasts for 30% at the most of the overall time of motion and preferably lasts between 10 and 20% of such time.

Figure 2:
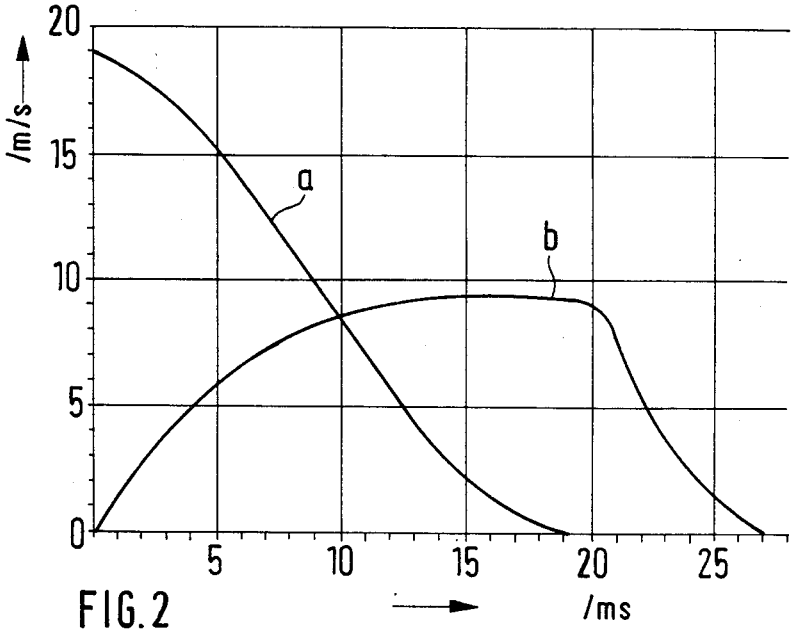
FIG. 2 is a speed-time graph as derived from FIG. 1.

The graph of FIG. 2 provides information with respect to changes in velocity of the pressing plate in the case of the methods of the prior art and of the invention. In the known method as in curve a in FIG. 2 the plate speed reaches its highest value at the instant at which the impact piston strikes, and thereafter continuously decreases linearly over a moderately long distance and in the terminal phase decreases degressively. On the other hand in the method of the invention as illustrated by curve b in FIG. 2 the plate speed increases more slowly till the maximum value is reached. The plate speed then remains approximately constant at this value before the relatively sudden onset of the terminal phase of degressive deceleration. In this respect the maximum plate speed is adapted to suit the height of the mold material and the desired degree of compaction.

Figure 3:
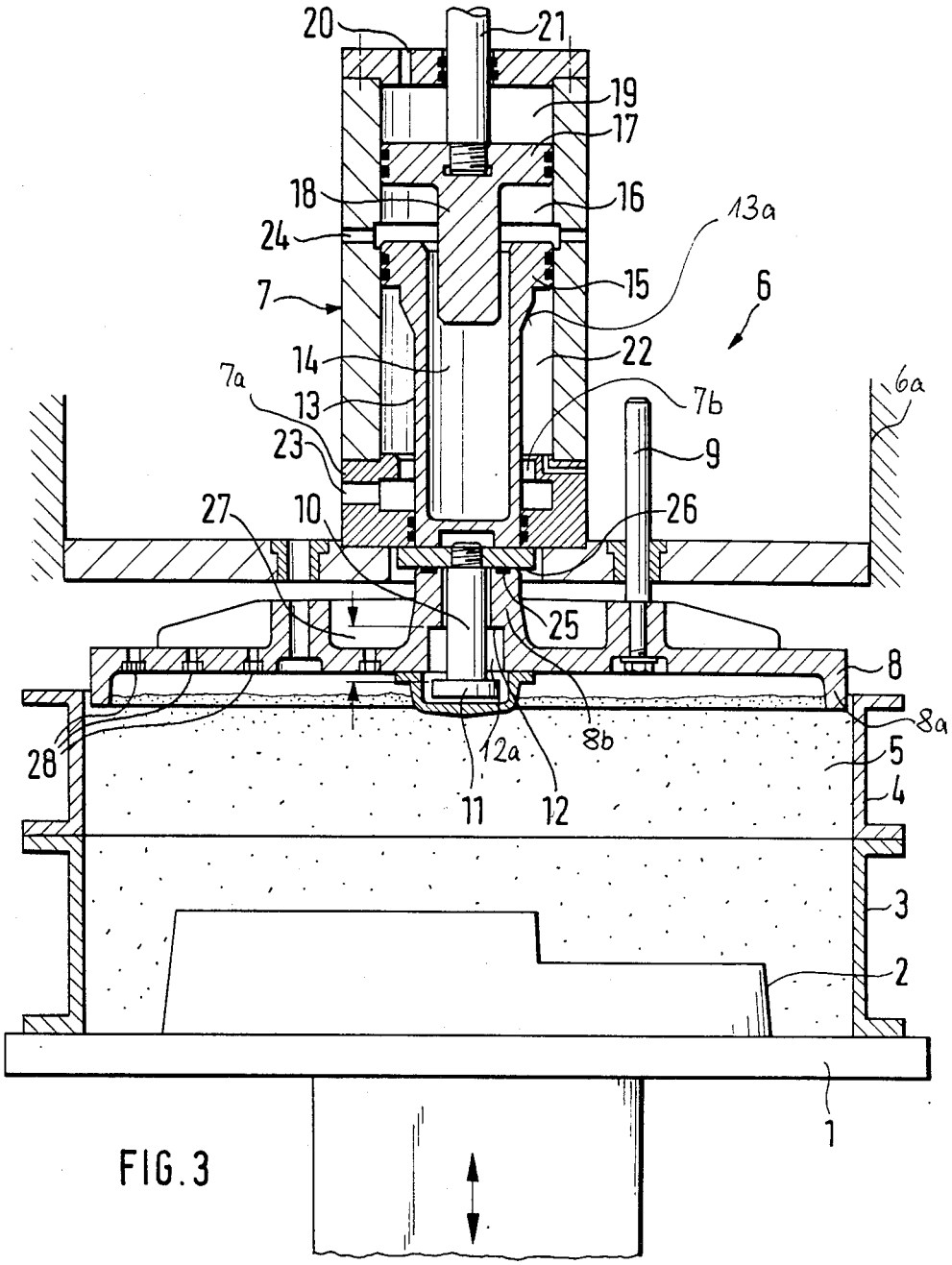
FIG. 3 is a diagrammatic section through one working example of the apparatus for undertaking the method of the invention.

FIG. 3 shows one working example of an apparatus for performing the method of the invention. A pattern 2 is mounted on a plate 1 that may be raised and lowered and is surrounded by a flask 3, on which a filling frame 4 is placed. The flask 3 and the filling frame 4 are filled in a conventional manner before compaction with mold making material as for example bentonite-bound foundry sand 5.

Over this mold unit there is a compaction unit generally referenced 6 whose principal parts are a pressure cylinder 7 and a pressing plate 8. In the present working example illustrated, the pressing plate 8 has a downwardly projecting peripheral skirt 8*a* and has guide rods 9 running in bushes in the stationary part of the compaction unit 6. The pressing plate 8 is furthermore guided at its middle part with a hub 8*b* on a pin 10 so that it may be moved axially therealong to a limited extent as far as a check stop in the form of a collar 11 on the end of the guide pin 10. The collar is designed to run up against a shoulder 12 in a recess 12*a* in the pressing plate 8.

The guide pin 10 is mounted on the piston rod 13 of a driving piston 15 that—like the piston rod 13—is made with a cylindrical cavity 14. The piston rod 13 and the piston 15 constitute the lower limit of a cylindrical cavity 16, same functioning as a pressurized gas storage means. The top limit of the volume of this storage means 16 takes the form of a setting piston 17, that has a head 18 projecting into the cylindrical cavity 14 of the piston 15. The setting piston 17 for its part, walls in a pressure storage space 19, that is connected with hydraulic liquid under pressure by way of a port 20. Furthermore the piston 17 is acted upon by a driving rod 21, that runs out through the top cover of the pressure cylinder 7.

A hydraulic chamber 22 (acting as a hydraulic counter pressure means) is confined or walled in by the driving piston 15, the pressure cylinder 7, the piston rod 13 and the lower cylinder cover, such chamber 22 being able to be supplied with hydraulic fluid by way of ports 23 (only one shown), that furthermore serve for discharge.

The pressurized gas storage means 16 may furthermore be connected via ports 24 with one or more further pressurized gas storage means of constant volume, that may function to make good any leakage losses or they may be able to be put in and out of circuit for changing the total size of the stroke. Over the driving piston 15 there is a gas pressure of between 50 and 200 bars, whereas the hydraulic chamber 22 is connected with a counteracting pressure between 100 and 350 bar, depending on the ratio of the acting surfaces of the piston.

In FIG. 3 the starting positions of the parts before a compaction stroke are shown. In advance the pressing plate 8, resting against the filling 5 of mold material together with the mold flask 3 and the filling frame 4, have been lifted into the upper position by the pattern plate 1 while being guided on the guide pin 10 as far as possible, that is to say till the upper end face 25 of its central hub 8*b* strikes against a stop disk 26 or end of the piston rod 13. The driving piston 15 is acted upon by a loading gas pressure, that has been produced by upward motion of the piston as caused by the hydraulic fluid entering into the hydraulic chamber 22.

On releasing the hydraulic fluid in the hydraulic chamber 22 through the ports 23 the driving piston 15 with the piston rod 13 and the pressing plate 8 and finally the filling 5 of mold making material are accelerated towards the pattern 2. The cross section of the outlet ports 23 is such that the discharge velocity at any event has a value of over 10 meters per second so that piston speeds between 2 and 20 meters per second may result. The drop of the gas pressure as a function of time in the gas storage means 16, the active surface of the driving piston 15, the mass of the piston, the mass of the pressing plate 8, the rate of hydraulic discharge and furthermore the area of the flask and the height of the compaction stroke are controlling for the speed of compaction and so for the properties of the mold produced. If there is a number of discharge ports 23 with a rated width of the order of 10 mm in size it is possible to obtain oil return speeds of up to 40 meters per second. Further details of this control system will be seen later on with respect to FIG. 5.

The driving piston is slowed down before reaching its end position. For this purpose the piston rod 13 comprises a conical enlargement 13*a* at its upper end. At the lower end of the pressure cylinder 7 within the hydraulic chamber there is mounted a damping ring *7a*. The opening *7b* of the damping ring is passed by the piston rod 13. The cross section of the annular opening between the piston rod and the inner wall of the damping ring *7a* is substantially greater than the cross section of the outlet ports 23. When the conical enlargement 13*a* of the piston rod 13 begins to enter into the opening *7b* of the damping ring the free cross section will be progressively reduced so that the hydraulic fluid is throttled until the piston stops.

Thereafter the limited axial clearance of the pressing plate 8 on, and in relation to the guide pin 10 leads to a free stroke, that is marked as 27 in FIG. 3. This makes it possible to automatically allow for fluctuations in the properties of the molding material by producing the different compaction strokes needed therefor. In fact, once the driving piston 15 has reached its terminal position (which is adjustable), the pressing plate 8 will travel as far as such terminal position, that is dependent on the residual ability of the molding material particles to flow and then move on further because of its inertia and will have an additional compacting effect on the back of the mold.

The pressing plate has slots, other forms of holes or nozzles 28 to avoid producing flaws in the mold that would otherwise be likely because of the trapping of air at the high compaction speeds in the column of mold material under the pressing plate 8.

The volume of the pressurized gas storage means 16, that also includes the volume of the cylindrical chamber 14 (which is provided to cut down weight) may be set using the setting piston 17. In this way it is possible to vary the initial pressure and therefore the initial acceleration of the driving piston. The terminal pressure as well remains constant, if the piston stroke is constant, whatever the arrangement of the setting piston 17. The change in acceleration as a function of time may however, as already indicated, be varied by connection with an external gas storage means by way of the ports 24. This additional gas storage means will be pumped up to its initial pressure when the driving piston 15 is returned by the hydraulic medium.

Figure 4:
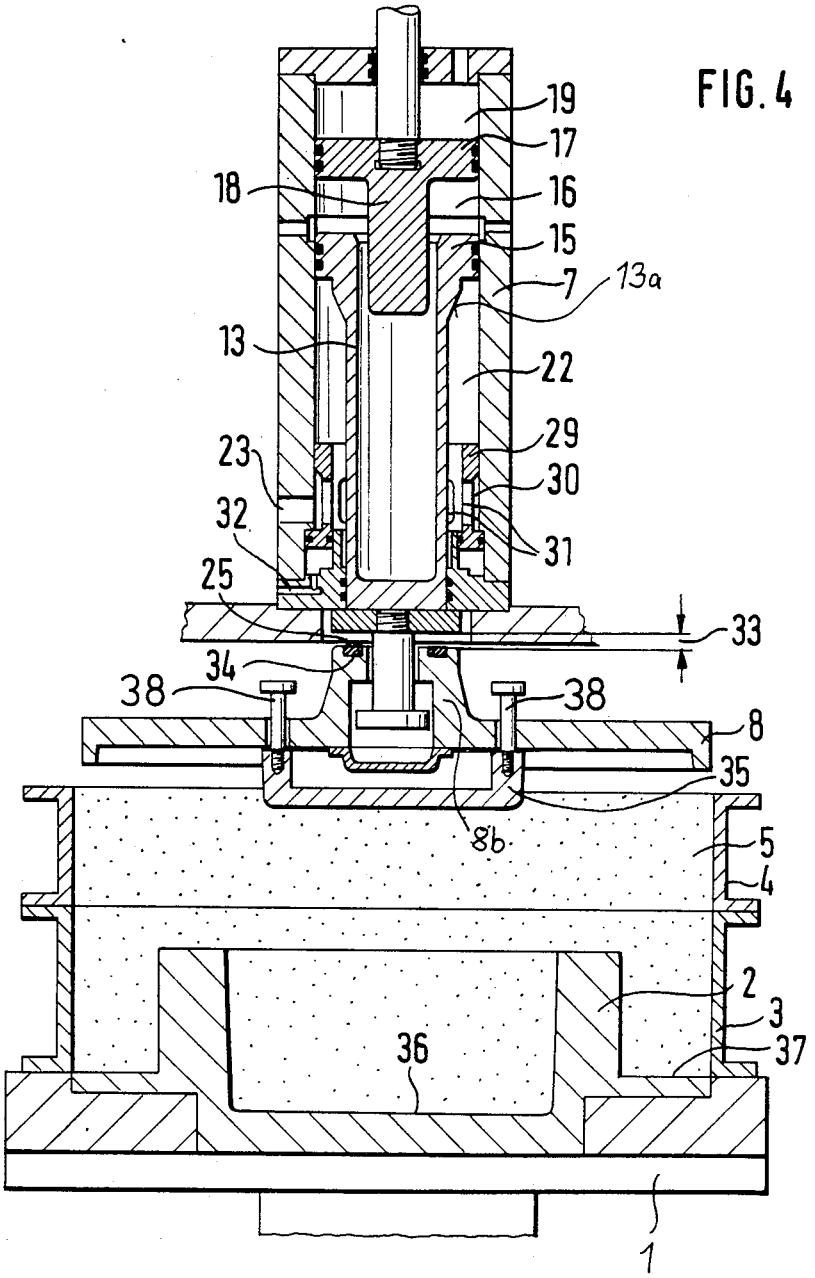
FIG. 4 is a section that is generally comparable with FIG. 3 but is taken through a further embodiment of the instant invention.

FIG. 4 shows a working example of the invention designed to make possible an adjustment of the compaction stroke, as for example to adapt it to different pattern geometries. Instead of the fixed damping ring 7*a* of FIG. 3 in the lower part of the hydraulic chamber 22 of FIG. 4 there is an adjustable choke sleeve 29, that has a ring-like space 30 machined into it so that a part of its surface (i.e. the part forming the radially inner limit of such space) is spaced from the inner face of the pressure cylinder 7. The choke sleeve 29 is furthermore provided with a number of openings 31 communicating with the ports 23 of the hydraulic chamber 22. The choke sleeve 29 may be axially set by means of hydraulic liquid acting on its lower end that is in the form of an annular piston with an annular space between the cylinder 7 and an upwardly extending part of the cylinder's lower end plate. The annular space has a port 32 for the admission of driving fluid thereinto. This choke sleeve is lowered or forced downwards by the hydraulic liquid in the hydraulic chamber 22. The length of stroke of the choke sleeve 29 is in this respect to be about 20 to 30% of the compaction stroke.

It is also possible to adjust the stroke setting of the driving piston 15 using a suitable lifting means for the pattern plate 1 so that any desired portion of free stroke as marked 27 in FIG. 3 will be available as free backlash 33 of the pressing plate 8 and a full stroke of the driving piston 15 results in a smaller stroke of the pressing plate 8. In the case of this form of the invention it is more specially an advantage to arrange an elastic cushion ring 34 on the central hub 8*b* of the pressing plate 8 in order to reduce noise on impact.

In the case of some patterns with unusual forms having parts thereof at greatly differing levels, different sizes of compaction stroke will be needed in different zones. This is something that may be effected by having additional masses on the pressing plate 8, that are adapted to the contour or outline of the pattern. In this respect a particularly beneficial effect may be produced if such additional masses are attached by means enabling them to be moved in relation to the pressing plate 8 in an axial direction so that there is a degree of axial clearance for such masses and they are automatically take up extra travel during the compaction stroke as occasioned by fluctuations in the properties of the molding material. In FIG. 4 such an additional compaction mass 35, that is used with a large convexly shaped pattern is shown, the lower face 36 of which extends as far a level under the parting plane 37. The additional pressing plate mass 35 is guided by upright studs 38 on the pressing plate 8. In the initial position the stroke of the pattern plate 1 causes the additional pressing plate mass 35 to come into engagement with the lower face of the pressing plate 8. During the ensuing compaction stroke there is firstly an acceleration of the mold making material under the additional pressing plate mass 35 and then later the rest of the lower face of the pressing plate runs against the back of the molding material. Thereafter the entire mass of molding material experiences further acceleration. On the piston 15 reaching its end position, the pressing plate 8 and the additional pressing plate mass 35 continue moving because of their inertia independently of each other and in a way dependent on the zone-wise or local compaction of the mold making material until they reach their final positions.

Figure 6:
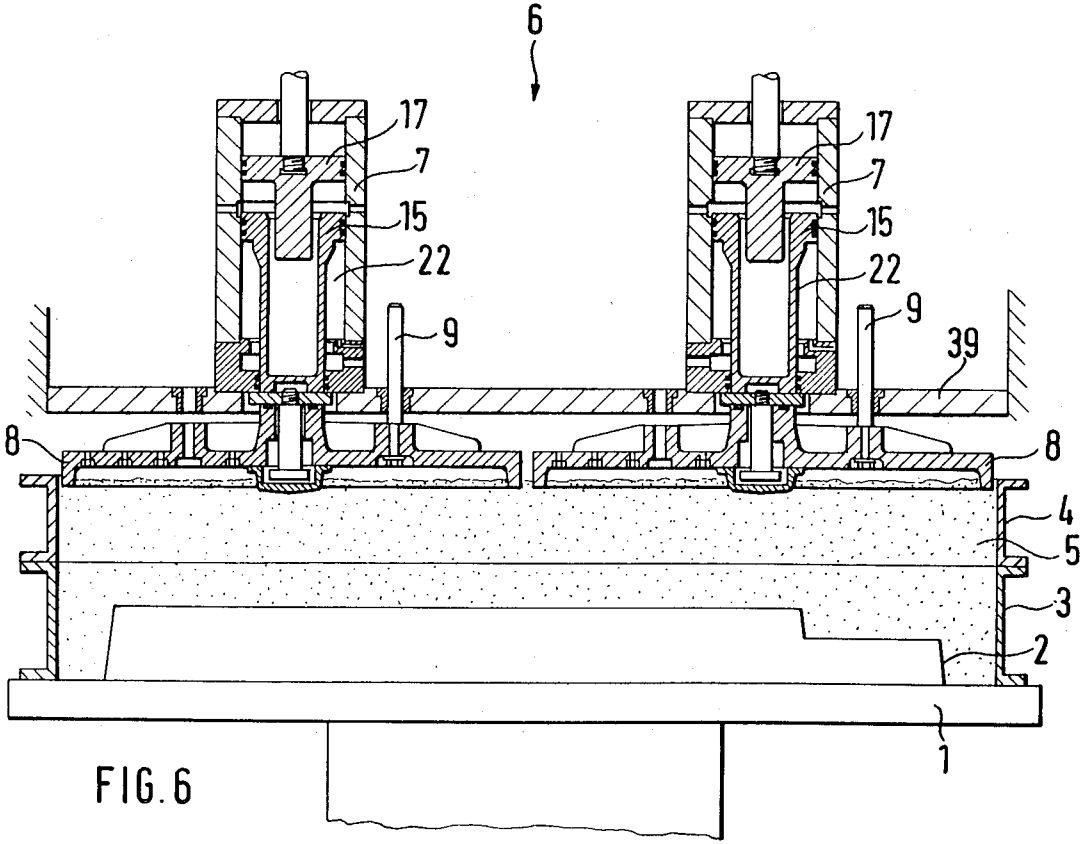
FIG. 6 is a section resembling those of FIGS. 3 and 4 but taken through a further working example of the present invention.

FIG. 6 shows a further form of the invention that is more specially suited for large flasks. In this case two compacting assemblies 6 are mounted on a common support 39 alongside each other, each having its own pressing plate 8 to respectively cope with or act over about one half of the cross section of the mold flask 3 or the filling frame 4. The compaction strokes of the two compaction assemblies 6 may be triggered at the same time, but however no absolutely simultaneous motion in step is needed. It is however best if the control means for the discharge of the hydraulic liquid from each hydraulic chamber 22 of each pressure cylinder 7 are placed in parallel and they are fed from a pressure equalizing duct. The form of the invention to be seen in FIG. 6 may furthermore be modified in such a way that at one and the same time the drags and copes of a complete box mold are produced in one single working stroke.

Figure 5:
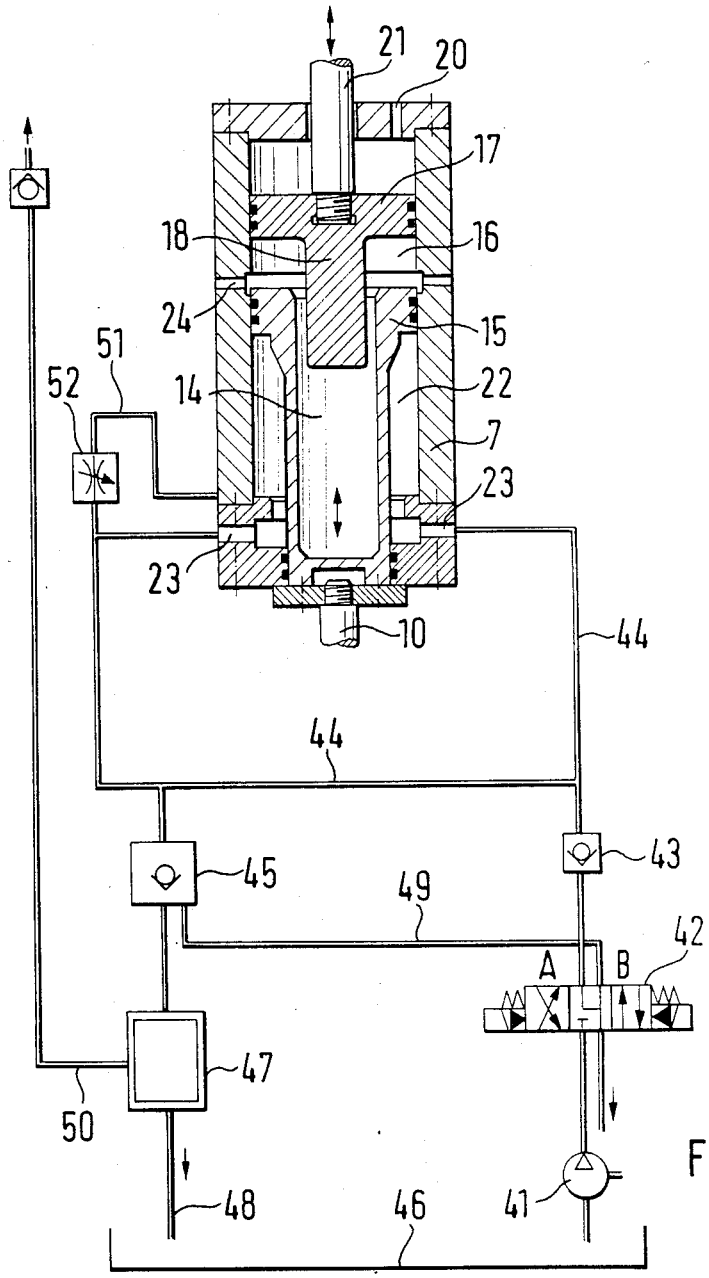
FIG. 5 is a schematic of a hydraulic circuit.

FIG. 5 shows an advantageous working example of the hydraulic control system. The ports 23 are joined up with a high-pressure hydraulic circuit with a means, as for example a hydraulic pump 41. It is fed from a tank 46. From such pump 41 the hydraulic liquid passes via a three-way controlling valve 42 and a check valve 43 into branch ducts 44 supplying it to the ports 23 of the hydraulic chamber 22 acting as the hydraulic counter pressure means. The branch ducts 44 are furthermore connected by way of a check valve 45 with an enclosed drain tank 47, whose outlet port 48 runs into the tank 46 and furthermore has a venting outlet 50. The check valve 45 is joined by way of a control line 49 with the control valve 42 so that it may be opened from the hydraulic pump 41. If desired, the hydraulic chamber 22 may be further joined by a line 51 and a fine adjustment choke 52 with the branch ducts 44 for adjusting the speed of the piston 15.

In the "B" position of the valve 42, the hydraulic chamber 22 is supplied from the hydraulic pump 41 so that the driving piston 15 travels upwards and brings the volume of gas in the storage means 16 up to the desired pressure. The controlled check valve 45 is then in the closed position. The pressing plate 8 has been moved over into its upper initial position in relation to the piston 15 by the follow up motion of the pattern plate 1 with the flask 3 and the filling frame 4.

By switching over the control valve 42 into the "A" position the hydraulic chamber 22 is shut off from the hydraulic pump 41 but because of the presence of the check valve 43 fluid is not able to be discharged through the valve 42. Simultaneously the pump opens the check valve 45 via the control line 49. The hydraulic liquid is able to discharge through the ports 23, the branch ducts 44 and the open check valve 45 suddenly into the discharge tank 47, whose capacity is large enough to receive the full amount of hydraulic liquid in the system. When this happens, the driving piston 15 and the pressing plate 8 are driven downwards with the desired speed in order to compact the filling 5 of mold making material.

Figure 7:
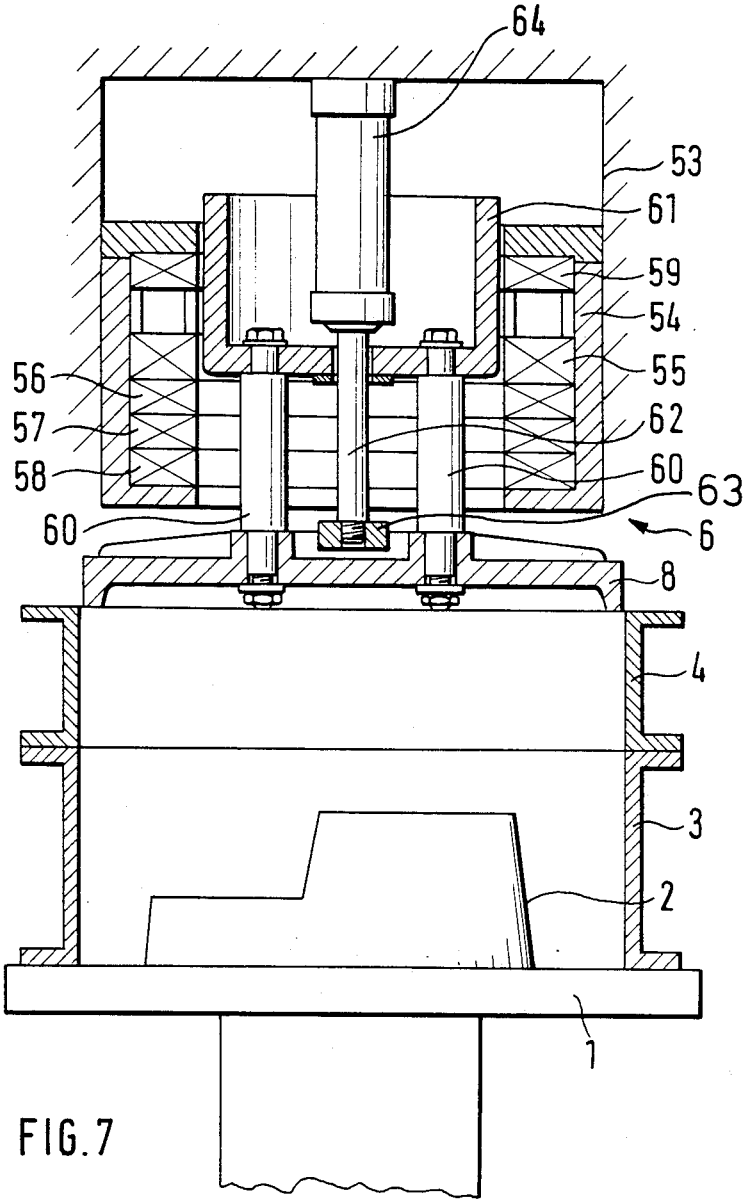
FIG. 7 is lastly a section like that of FIGS. 3 and 4 showing a working example of the invention with an electromagnetic drive.

Lastly FIG. 7 shows a working example of a compacting assembly 6 with an inductive (e.g. electromagnetic) drive. A coil support 54 with a number of vertically stacked coaxial coils 55, 56, and 58 is mounted in the machine frame 53. The coils may be separately excited and controlled. There is furthermore a stabilizing and retaining or hold coils 59 placed over the stack of coils 55 to 58. The pressing plate 8 is fixed by bars 60 on an armature 61, that has the rod 62 of a return piston and cylinder 64 fitting into it. The rod 62 has an end driver collar 63.

The cylindrical coils 55 to 59 produce a homogenous, alined electromagnetic field, that automatically aligns the armature 61 axially when it is in the resting position or also when it is moving. The compaction stroke may be modified in steps by changing the number of coils 55 to 58 that are put in circuit. The acceleration function is influenced by the field strength acting on the armature 61 and, given the right design, will be within the saturation range of the material of the armature. The properties produced by the compaction may therefore not only be varied by the modification of the compaction stroke but furthermore by changing the intensity of current flowing through the winding.

After compaction the pressing plate 8 is moved back into its initial position by the return cylinder 64 and latched by turning on the hold winding 59. Prior to each compaction stroke the piston rod 62 is moved out into its position as pictured in FIG. 7.

I claim:

1. A method of compacting foundry mold making material by the compression stroke of a pressing plate, said pressing plate being moved at a speed of up to 20 meters per second, said method comprising the steps of placing said pressing plate directly against a surface of such material, accelerating the pressing plate in an initial phase of said stroke, said initial phase lasting for up to 50% of the total compression stroke duration, such acceleration being progressive and bringing the pressing plate up to the maximum speed in said stroke, moving said pressing plate in a subsequent second phase of said stroke at a generally constant speed and then decelerating said pressing plate in a subsequent terminal phase of said stroke, said terminal phase lasting for 30% at the most of the total stroke duration.

2. The method as claimed in claim 1 wherein said speed of said pressing plate is made inversely proportional to the height of said mold making material.

3. The method as claimed in claim 2 wherein for a height of said mold making material equal to up to 200 mm said pressing plate speed is equal to between 20 and 12 meters per second, for a value of said height between 200 and 300 mm said speed is equal to between 12 and 7 meters per second and for a height equal to over 400 mm said speed is equal to between 7 and 2 meters per second.

4. The method as claimed in claim 1 characterized in that the pressing plate is driven by a preloaded springlike means adapted to store energy and release it instantaneously for driving said plate.

5. The method as claimed in claim 4 wherein said springlike means comprises means for holding gas under pressure and driving said plate by releasing the energy of pressurization of said gas.

6. The method as claimed in claim 5 wherein said gas is recompressed after driving said plate.

7. The method as claimed in claim 5 wherein said maximum plate speed is set by controlling the level of said gas pressure and the gradient of expansion of said gas is controlled as a function of time by hydraulic opposing pressure.

8. The method as claimed in claim 5 comprising more than one gas pressure means for driving said pressing plate, said separated means being opened for discharged of gas therefrom in sequence.

9. The method as claimed in claim 5 wherein in said terminal phase said pressing plate is uncoupled from the driving force of said gas and is only decelerated to its end position by the resistance of said mold material opposing the inertia of said plate.

10. The method as claimed in claim 1 wherein said pressing plate is driven electromagnetically.

11. The method as claimed in claim 10 wherein along the stroke of the pressing plate, magnetic fields of controlled intensity are caused to take effect.

* * * * *